United States Patent [19]

Matthews

[11] 4,068,605

[45] Jan. 17, 1978

[54] NEEDLES

[75] Inventor: Denis Matthews, Sutton-in-Ashfield, England

[73] Assignee: Mathbirk Limited, England

[21] Appl. No.: 743,796

[22] Filed: Nov. 22, 1976

[30] Foreign Application Priority Data

Nov. 12, 1975 United Kingdom ..... 50933/75
Dec. 20, 1975 United Kingdom ..... 52292/75

[51] Int. Cl.[2] ..... D05B 85/14
[52] U.S. Cl. ..... 112/223
[58] Field of Search ..... 112/222, 223, 224; 223/103, 104; 66/121

[56] References Cited

U.S. PATENT DOCUMENTS

| | | | |
|---|---|---|---|
| 415,310 | 11/1889 | Merrow | 112/222 X |
| 1,831,872 | 11/1931 | Messing | 66/121 X |
| 3,327,498 | 6/1967 | Matthews | 66/121 |

FOREIGN PATENT DOCUMENTS

| | | | |
|---|---|---|---|
| 586,678 | 10/1933 | Germany | 66/121 |
| 1,166,919 | 4/1964 | Germany | 66/121 |

*Primary Examiner*—George H. Krizmanich
*Attorney, Agent, or Firm*—Michael J. Striker

[57] ABSTRACT

An imperforate needle for use with a textile machine has a shank and a cut-out provided with a latch capable of opening and closing the cut-out without extending beyond the contour of the needle.

6 Claims, 4 Drawing Figures

NEEDLES

It is well known to provide a needle for a linking machine which needle is adapted to pierce fabrics mounted onto radial extending points on a dial. The needle draws a yarn through the fabrics to form a chain stich, thus linking two or more fabrics together. This invention is particularly concerned with an imperforate needle having a cut-out formed therein and with a part which extends over the cut-out to close it. Such needles are known in the art as latch needles.

One of the disadvantages of a latch needle is that with the latch in the open position, that is to say when not extending over the cut-out, the effective diameter of the needle is increased by the point of the latch extending away from the shank of the needle, since the latch stands proud of the needle shank.

This can create two disadvantages. The first is that when relatively fine fabric is being linked, the piercing of the fabric with the latch in the open position may cause snagging or damage to the fabric by the tip of the latch being forced through the fabric. Secondly, when the needle is withdrawn it is intended that the back of the latch shall hit the fabric and close the latch, but in some instance the point of the latch may dig into the fabric causing jamming and probably the breaking of the needle and certainly the interruption of the linking process.

It is with the object of providing an improved type of latch needle for use with linking machines that the present invention is concerned.

The present invention provides an imperforate needle particularly for use with a linking machine, said needle having a shank with a pointed end, a cut-out formed in the shank and a pivoted latch for closing the entrance to the cut-out, said latch being mounted in such a manner that in the "open" position, that end of the latch which would extend over the cut-out in the "closed" position, lies substantially within the circumference of the shank.

In order that the present invention may be more readily understood, reference is now made to the accompanying drawings.

Figure 1:
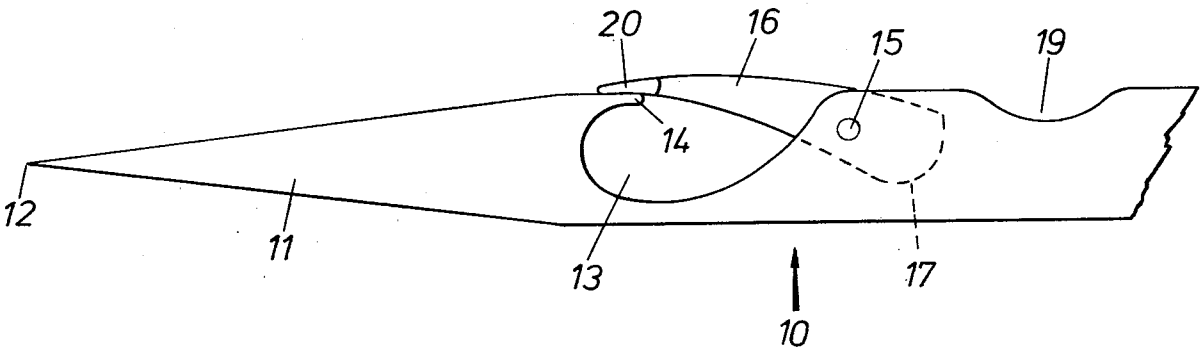
FIG. 1 shows a needle according to one embodiment of the invention with the latch in closed position.

In the drawings, a needle is illustrated generally at 10 and is formed of a shank with a pointed tip 12 mounted on a tapering portion 11. A cut-out in the shank 13 is provided, said cut-out being formed with a nib 14 rearwardly facing relative to the point 12. The cut-out 13 is large enough to accommodate yarn therein which is withdrawn through the fabric during the linking operation. A latch 16 is provided which is pivoted by means of a pin extending through an aperture 15 formed in the shank of the needle. The end of the latch 16 has a spoon end 20 which is in the form of a small channel section to fit over the nib 14 when the latch is in the closed position.

Figure 2:
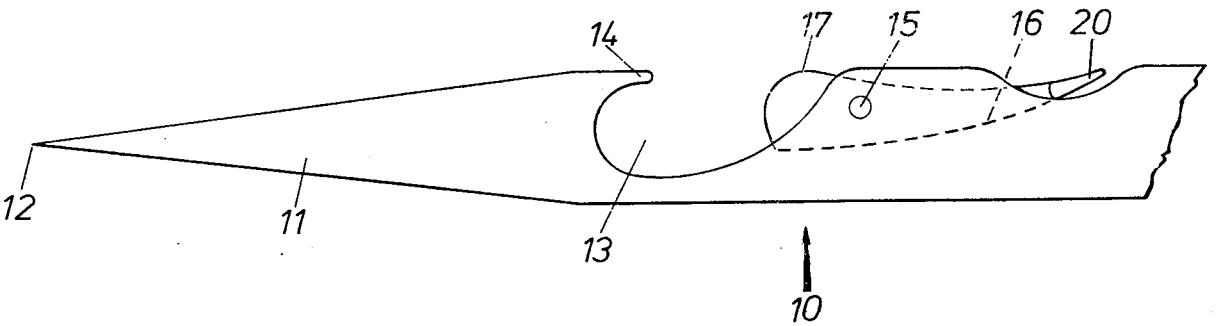
FIG. 2 shows the needle of FIG. 1 in open position.
Figure 3:
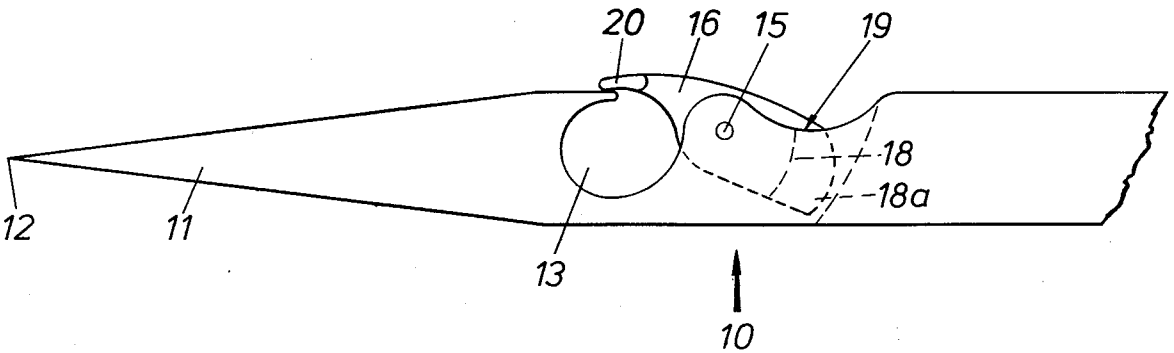
FIG. 3 shows a needle according to a further embodiment of the invention with the latch in closed position.
Figure 4:
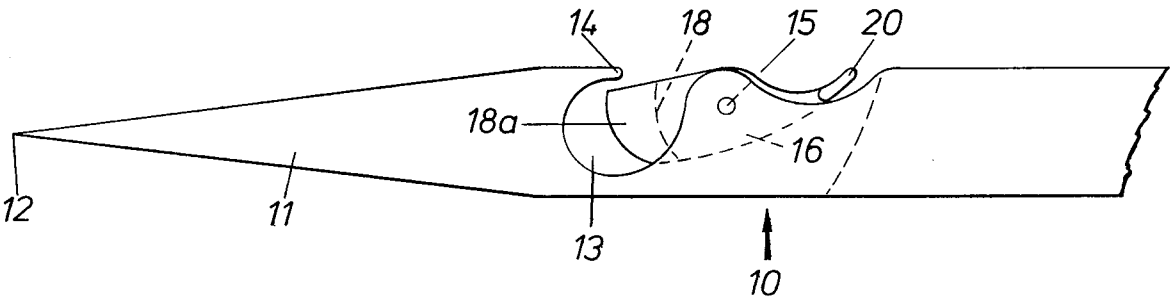
FIG. 4 shows the needle of FIG. 3 with the latch in open position. The reference letters used in the accompanying drawings refer to like parts in the drawings.

A further cut-out 19 is provided in the shank of the needle to accommodate the spoon 20 when the latch is in the "open" position (FIGS. 2 & 4).

The latch 16 is provided with a heel part 17. In FIGS.: 1 & 3, the latch 16 is shown in the closed position while in FIGS.: 2 & 4 it is shown in the open position and it will be appreciated that in FIGS.: 2 & 4 that the end 20 of the latch 16 which extends over the nib 14 when in the closed position, lies substantially wholly within the circumferences of the shank of the needle 10. When the needle pierces the fabric the latch will be in the open position as shown in FIGS.: 2 & 4 thus the overall diameter of the needle which pierces the fabric is substantially that of the shank of the needle. Yarn is then laid into the cut-out 13 and as the yarn is laid on it will be drawn in over the shank, hit the heel 17 and rotate the latch into the closed, or partially closed, position. As the needle is then withdrawn, the back of the latch 16 will then hit the fabric though pierced by the needle and fully close the latch thus shielding the nib 14 from the fabric through which the yarn, located within the cut-out 13, is being drawn in order to form the chain stitch.

In FIGS.: 3 & 4 two lines 18 and **18*a* indicate alternate lengths of the heel 17 of the latch. If the latch has a heel indicated by line 18*a* it substantially closes the cut 13 but will clearly ensure that the yarn rotates the latch about the pin 15. If the heel is as indicated by line 18** the latch will be lighter and thus requires less force to open and close it. It is thought that other considerations may apply as to the preferred length of the heel depending upon the nature of the fabrics being linked and yarn used for linking them together.

It is thought that providing a latch which is rotatable to an extent that enables the tip of the latch to lie within the circumference of the shank of the needle, that a substantially improved needle, particularly for use with linking machines, is provided.

What we claim is:

1. An imperforate needle for use with a textile linking machine, comprising an elongated shank having a pointed end and a cut-out with an inlet opening for inserting a thread through the latter and into said cut-out, said cut-out having a dimension in a direction substantially transverse to the direction of elongation of said shank, which is substantially commensurate with the thickness of said shank; and a latch element having at least two portions spaced from each other, said latch element being pivotable between a closed portion in which one of said portion bridges said inlet opening of said cut-out so as to close the same, and a second position in which said one portion of said latch element is retracted from said inlet opening and located substantially within the outer circumference of said shank as seen in said transverse direction, whereas the other portion of said latch element in said second position at least partially extends into said cut-out so as to be engaged by the thread during insertion of the latter in said cut-out whereby said latch element is pivoted from said open into said closed position.

2. The needle as defined in claim 1, wherein said shank has a pointed edge portion adjacent to said inlet opening of said cut-out, said one portion of said latch element having a spoon-like end section engaging said edge portion of said shank in said closed position.

3. The needle as defined in claim 1, wherein said shank has a pointed edge portion adjacent to said inlet opening of said cut-out and said one section of said latch element has an end section adjacent to said edge portion of said shank in said closed position, said shank having a recess which is formed rearwardly relative to said cut-out and accommodates said end section of said one portion of said latch element in said open position so that said end section is located substantially within the outer circumference of said shank.

4. The needle as defined in claim 1, wherein said one and said other portions of said latch element are so loated relative to each other, and said latch element is so pivoted between said positions, that when said latch element is in one of said positions said one portion thereof occupies substantially the location which is occupied by the other portion of the latch element in the other position, and the other portion of the latch element occupies the location which is occupied by said one portion thereof in the other position.

5. The needle as defined in claim 4, wherein said latch element is pivotable between said positions through an angle equal to substantially 180°.

6. The needle as defined in claim 4, wherein said latch element is elongated and pivotable about a pivot point, said one portion of said latch element having an end section, said other portion of said latch element having a further end section, said end section and said further end section being spaced from each other and from said pivot point of said latch element in the direction of elongation of the latter.

* * * * *